United States Patent [19]

Nixdorff

[11] 4,028,863

[45] June 14, 1977

[54] METHOD OF MANUFACTURING CONTAINER SAFETY CLOSURE SYSTEM

[75] Inventor: Frank S. Nixdorff, Baltimore, Md.

[73] Assignee: Anchor Hocking Corporation, Lancaster, Ohio

[22] Filed: Feb. 25, 1976

[21] Appl. No.: 661,272

Related U.S. Application Data

[62] Division of Ser. No. 522,619, Nov. 11, 1974, Pat. No. 3,958,709.

[52] U.S. Cl. ..... 53/15; 53/38

[51] Int. Cl.[2] ..... B65B 7/28

[58] Field of Search ..... 53/15, 38; 215/216, 215/221

[56] References Cited

UNITED STATES PATENTS

| | | | |
|---|---|---|---|
| 3,019,931 | 2/1962 | Thornton | 215/221 |
| 3,567,057 | 3/1971 | Landen | 215/221 |
| 3,744,655 | 7/1973 | Nixdorff, Jr. | 215/216 |
| 3,884,379 | 5/1975 | Landen | 215/221 |
| 3,901,400 | 8/1975 | Westfall | 215/221 |

*Primary Examiner*—Travis S. McGehee
*Assistant Examiner*—J. Sipos
*Attorney, Agent, or Firm*—Connolly and Hutz

[57] ABSTRACT

A safety closure system includes a cap removably mounted on the neck of a container and prevented from undesired opening by means of a locking ring mounted on the container neck and which locking ring has means such as tooth engaged with complementary locking means such as notches on the cap. The cap and locking ring also contain positioning means to orient the ring with respect to the cap so as to assure proper engagement of the ring locking means with the cap locking means. During assembly the ring is loosely mounted on the neck and mounting of the cap mounts the ring in place.

8 Claims, 15 Drawing Figures

METHOD OF MANUFACTURING CONTAINER SAFETY CLOSURE SYSTEM

CROSS-REFERENCE TO RELATED APPLICATION

This application is a division of application Ser. No. 522,619, filed Nov. 11, 1974, now U.S. Pat. No. 3,958,709.

BACKGROUND OF THE INVENTION

There is an ever increasing need for effective safety closures such as closures which prevent accidental opening of a container as by children. A number of approaches in the prior art has been taken. Exemplary of these are U.S. Pat. Nos. 3,892,326, 2,980,275; 3,019,931 and 3,567,057. An arrangement which has met with warm acceptance is disclosed in U.S. Pat. No. 3,744,655. In that patent the neck is provided with a locking ring which has thereon a hinged tab carrying a locking tooth for engagement with notches in the cap. To disengage the locking tooth the tab is depressed so that the cap can be unscrewed in a conventional manner. A further arrangement which incorporates the principles of U.S. Pat. No. 3,744,655 is to provide a pair of oppositely disposed tabs on the locking ring with the locking teeth, however, being not quite 180° apart. This further arrangement has the obvious deficiency in its removal operation since it requires the locking teeth on both tabs to be manipulated out of engagement with the cap notches while the cap itself is being unscrewed.

While the hinged tab arrangement of U.S. Pat. No. 3,744,655 has been successful, it is possible that occasionally during assembly of the cap on the ring, the locking tooth will not be exactly registered in the desired position with respect to the notches in the cap. For example the cap notches contain slanted faces and the notches terminate in an apex. The ring locking tooth is similarly shaped and ideally should fit within the notch at the apex. If, however, during assembly the tooth abuts against the slanted notch wall rather than fitting in the apex there is a tendency to urge the hinged tab downwardly with a notch apex. Where on occasion the locking tooth is not positioned in its ideal location with respect to the cap notches, this improper positioning may be maintained over a long period of time such as while the container is in transit and is being stored prior to sale. When the container is subsequently used by removing the cap, the tab might tend to return only to the position it had during the long period of storage whereupon it might not register completely with the apex of the notch even if disposed at the apex. Under such conditions the system would not function as an effective safety closure. This problem can be avoided by using a material which has proper "memory" characteristics. For example U.S. Pat. No. 3,744,655 discloses the use of a polycarbonate or Lexan (Reg. T.M. of G.E. Co.) as a suitable material. A plastic such as Lexan inherently retains it memory that is even if the tab should be depressed over a prolonged period such as by improper registration of the locking tooth in a cap notch, the tab would tend to return completely to its normal intended condition rather than be deformed in the improper position.

While Lexan has proven to be a successful material for use with closures of the above patent, materials such as Lexan have the disadvantage of being relatively expensive. It would, therefore, be desirable to provide a safety closure system having the advantages of the above noted patent yet capable of using more economical materials such as, for example, lower cost polypropylenes.

SUMMARY OF THE INVENTION

An object of this invention is to assemble a safety closure system particularly of the type disclosed in U.S. Pat. No. 3,744,655 which is capable of using low cost materials.

A further object of this invention is to assemble such a safety closure which incorporates means for assuring proper orientation of the ring locking means with respect to the cap locking means so that it is not necessary to use a "memory" retaining material.

In accordance with this invention a safety closure system is provided which includes a cap movably engaged with a neck of a container and with a locking ring mounted on the container to prevent accidental or undesired removal of the cap by the provision of locking means on the ring selectively engaging complementary locking means on the cap. A characteristic of the invention is that both the cap and locking ring contain positioning means to orient the cap locking means in the proper position with respect to the ring locking means. The positioning means are arranged so that when the cap positioning means contacts the locking ring positioning means both the cap and locking ring move jointly as a unit in the locking direction of the cap. This is accomplished by mounting the locking ring on the neck for unidirectional movement. Accordingly, the cap may be rotated downwardly on the container neck such as by the use of complementary threaded means, and the locking ring will rotate therewith in this closing direction with the ring locking means properly engaged in the cap locking means. Since the ring is mounted for only one directional movement the cap cannot be rotated in the reverse direction until its locking means is disengaged from the ring locking means.

In a preferred form of this invention the means for mounting the ring for unidirectional movement on the container neck includes spaced sets of ratchet teeth on the container neck which engages complementary ratchet teeth on the inner surface of the ring. The positioning means includes a pair of stop members or lugs on the ring engaged by a pair of camming surfaces on the cap so positioned that when the abutting faces of the camming surfaces contact the stop members the ring locking means, such as a locking tooth, is properly positioned with respect to the cap locking means, such as a respective notch in the cap.

THE DRAWINGS

DETAILED DESCRIPTION

The present invention is directed to a safety closure system which operates along the principles of U.S. Pat. No. 3,744,655. Accordingly, the details of that patent are incorporated herein by reference thereto. It is to be noted, for example, that although a number of embodiments are illustrated in that patent the following description is directed to only one such embodiment but that the concepts of this invention may be practiced with embodiments other than the specifically illustrated embodiment.

Figure 14:
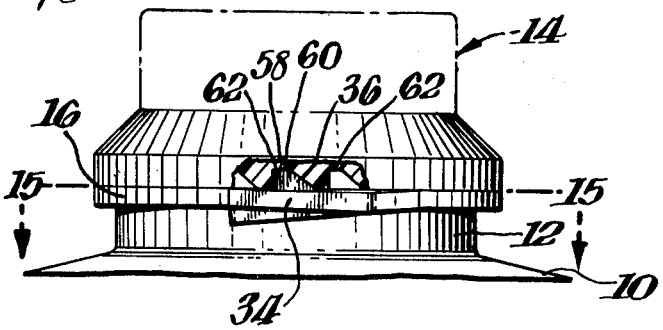
FIG. 14 is a side elevation view partly broken away of the assembled closure system.

As shown in FIG. 14, the safety closure system includes a container 10 having a neck 12 upon which is detachably mounted a cap 14 locked against accidental or undesired opening by means of a locking ring 16.

Figure 2:
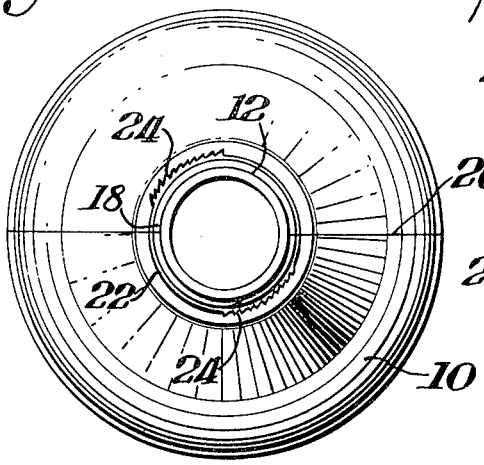
FIG. 2 is a top plan view of the container shown in FIG. 1.
Figure 3:
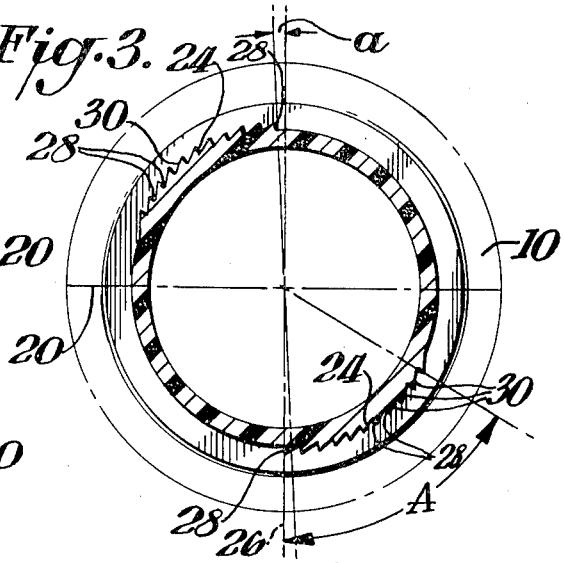
FIG. 3 is a cross-sectional view taken through FIG. 1 along the line 3—3.
Figure 1:
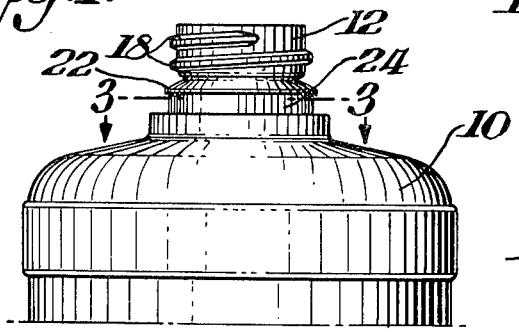
FIG. 1 is a front elevation view of a novel container in accordance with this invention.
Figure 8:
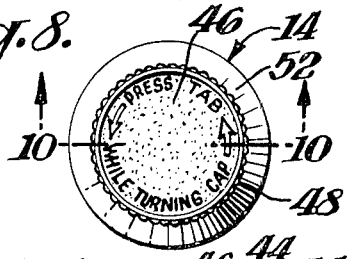
FIG. 8 is a top plan view of the cap shown in FIG. 7.
Figure 7:
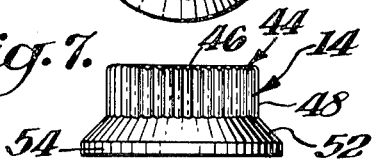
FIG. 7 is a side elevation view of a cap utilized in the closure system of this invention.

FIGS. 1–3 show the details of container 10. As indicated therein, neck 12 has external threads 18. Container 10 is molded into desired shape as indicated by mold parting line 20 of FIG. 2. Below the threaded region, neck 12 includes a retention bead 22 and below bead 22 is mounting means 24. Mounting means 24 forms an important feature of the invention as later described. As illustrated in FIGS. 2–3, the mounting means are provided in two sets and are formed with one-way ratchet teeth and are arranged in a particular relative position with respect to each other. In this regard as shown in FIG. 3, the container neck may be considered as being divided into four quadrants which are defined by parting line 20 and imaginary perpendicular bisecting line 26. Each set of teeth 24 is disposed wholly within opposite quadrants. The individual teeth are each formed with an abutting face 28 and a camming face 30 at any desirable angle. For example, in the illustrated embodiment the angle between faces 28, 30 is 60°. Correspondingly to prevent undercuts from being formed each segment 24 is disposed over an arc substantially equal to that angle. Thus where the angle between faces 28 and 30 is 60° the entire set of teeth of each segment is disposed in an arc at angle A of 60°.

This arrangement of the arc segment being substantially equal to the tooth angle is particularly important to assure the maximum number of teeth being formed in each segment without any undercuts and thus avoid problems attendant with undercuts. For example, if a slight undercut were formed by the teeth this would cause distortion in ejecting the parts from the mold and if a large undercut were formed, this might prevent ejection of the parts.

Another significant feature in the sets of teeth 24 is that first abutting face 28 in one of the segments is displaced away from quadrant line 26 by angle *a* so that the distance of face 28 from line 26 is less than the length of a tooth and preferably one half the length. The corresponding face 28 of the opposite set, however, is disposed at quadrant line 26. Thus one segment 24 is displaced or offset by one half the length of a tooth from being exactly diametrically opposite the other segment. Additionally, the last face 30 of each set is disposed generally perpendicular to parting line 20. This offset displacement of the sets of ratchet teeth 24 assures a positive locking action which, as later described, prevents the locking ring 16 from rotating in the unscrewing direction of cap 14 and thus the ratchet teeth permit relative rotation of the locking ring 16 in only one direction, namely, the closing direction of the cap.

Figure 5:
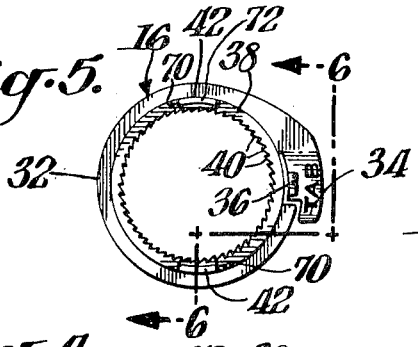
FIG. 5 is a top plan view of the locking ring shown in FIG. 4.
Figure 4:
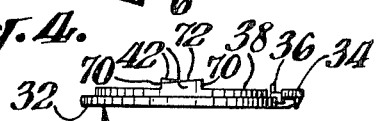
FIG. 4 is a side elevation view of a locking ring in accordance with this invention.
Figure 6:
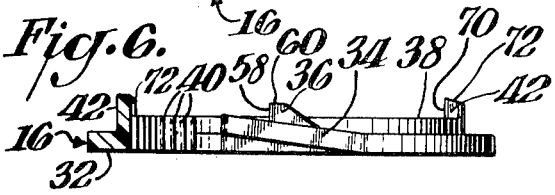
FIG. 6 is a cross-sectional view taken through FIG. 5 along the line 6—6.

FIGS. 4–6 illustrate the details of locking ring 16. As illustrated therein, ring 16 includes an annular body 32 having an offset hinged tab 34 at its outer surface with a locking tooth 36. Body 32 further includes an upstanding annular shoulder 38. The inner surface of body 32 is provided with ratchet teeth 40 which are shaped complementary to ratchet teeth 24 of neck 12. Thus when in place on neck 12 ring 16 would be mounted for unidirectional movement as previously noted. Mounted on the top of shoulder 38 is a pair of diametrically opposed stop members or lugs 42. Lugs 42 have a smooth inner surface so as not to cause any interference with retention bead 22 of neck 12.

Figure 15:
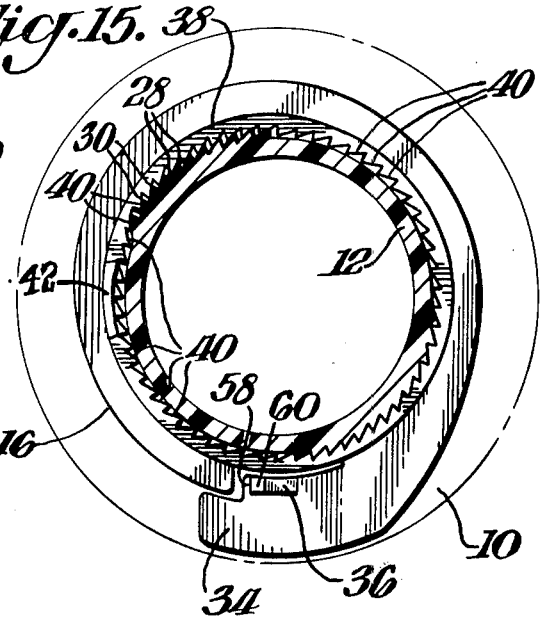
FIG. 15 is a cross-sectional view taken through FIG. 14 along the line 15—15.

In accordance with this invention the inner diameter of locking ring 16 as defined by the distance between the apices of diametrically opposed teeth 40 is substantially the same as the outer diameter of neck 12 as defined by diametrically opposed root portions of teeth 24. This equal nominal diameters is particularly advantageous in assuring a secure locking action of the ring on the neck when it is mounted in place. This locking action is best illustrated in FIG. 15. As shown therein because the teeth 24 of one segment are displaced or offset by less than a tooth length from being diametrically opposed to the other segment 24, it is impossible for teeth 40 to be precisely engaged with both segments 24 of neck 12 at the same time. Accordingly, as illustrated in FIG. 15, when there is a proper engagement of teeth 40 with respect to one segment 24 (e.g. lower portion of FIG. 15) teeth 40 are mounted on the slanted camming face 30 of the opposite segment. Moreover, since the ring and neck nominally have the same diameter, the attempted rotation counterclockwise or in the unscrewing direction of cap 14 causes the slanting faces 30 of the disengaged teeth to pull teeth 40 inwardly into an even better lock with regard to the engaged teeth at the lower portion illustrated in FIG. 15. In fact ring 16 is even slightly distorted to a slightly oval shape as illustrated in FIG. 15 by such reverse rotation. Thus by offsetting the segments 24 and by using the same nominal diameters for both the neck and ring there is greater assurement that the ring will be prevented against rotating in the opening direction of cap 14.

FIGS. 7–10 illustrate the details of cap 14. As indicated therein cap 14 includes a body member 44 having a top wall 46 for closing the discharge opening in neck 12. A cylindrical side wall 48 depends from top wall 46 and may be knurled, grooved or include other structure to facilitate gripping thereof by the user. The inner surface of wall 48 is provided with threaded means 50 for threadably engaging complementary threaded means 18 on neck 12. Side wall 48 terminates in an outwardly extending peripheral skirt 52 which is frusto-conically shaped and in turn terminates in a cylindrical wall portion 54. The inner surface of cylindrical wall portion 54 is formed with notches 56 of the type illustrated and described in U.S. Pat. No. 3,744,655. Locking tooth 36 on ring 16 is complementary shaped with respect to notches 56 so that tooth 36 is engaged in a corresponding notch 56 of the cap when the cap is mounted in place and the abutting or locking face 58 of tooth 36 prevents rotation of cap 14 in its unlocking direction. The cap may be removed by depressing tab 34 of locking ring 16 to disengage tooth 36 from its corresponding notch 56 as also described in the above noted patent.

Figure 10:
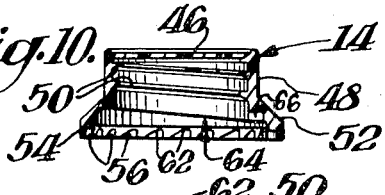
FIG. 10 is a cross-sectional view taken through FIG. 8 along the line 10—10.
Figure 9:
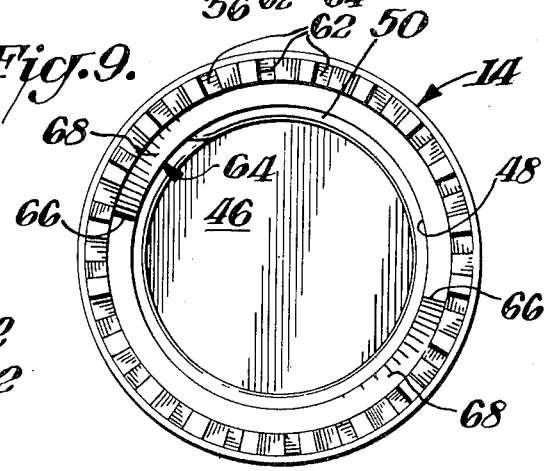
FIG. 9 is a bottom plan view of the cap shown in FIGS. 7–8.
Figure 13:
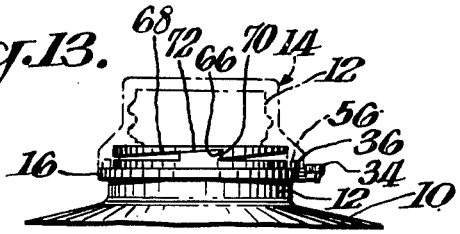

This invention incorporates means to assure that tooth 36 will be properly registered in a corresponding notch 56 with the apex 60 of tooth 36 positioned against a corresponding apex 62 in notch 56. This positioning means is best illustrated in FIGS. 9, 10 and 13 and operates in cooperation with lugs or stop members 42. The cap positioning means includes a pair of cam members 64 molded in cap 14 with each cam member 64 having a vertical contacting surface 66 with an upwardly sloping cam surface 68. As shown in FIGS. 9–10, cams 64 are disposed above and radially inwardly of notches 56. As later described each contacting surface is disposed for contacting a corresponding vertical contact surface 70 of lug 42. When these contacting surfaces abut each other locking tooth 36 is properly positioned with respect to a corresponding notch 56 so the apices 60, 62 are properly orientated as illustrated in FIGS. 13–14.

Figure 11:
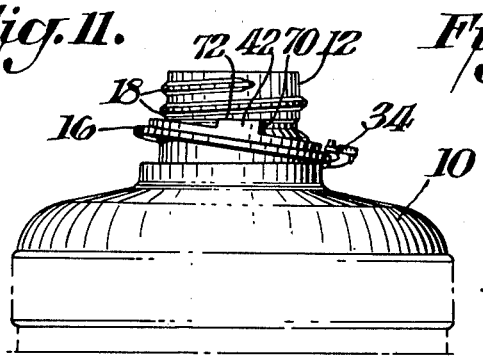
FIG. 11 is a side elevation view showing the locking ring loosely mounted on the container in a preliminary stage of assembly.

FIGS. 11–14 illustrate a manner of assembling the closure system. As illustrated in FIG. 11, the first step in the assembly procedure is to loosely place ring 16 on neck 12. This loose placement will result in the ring being arranged in any haphazard fashion and it will ultimately be necessary for the ring to be flattened or properly horizontally disposed for proper engagement with the neck.

Figure 12:
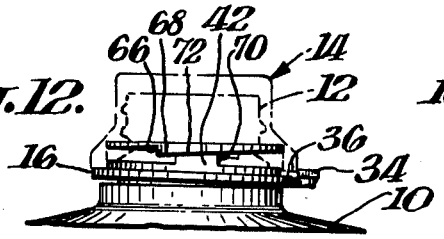
FIGS. 12–13 are side elevation views showing subsequent stages of assembly with the cap illustrated in phantom.

FIG. 12 illustrates a further step in the assembly operation. As indicated therein, cap 14 (shown in phantom) is placed on top of neck 12 and rotated by threaded engagement of complementary threaded means 18, 50. Lugs 42 each have a top wall 72 slanted downwardly away from contact face 70. Camming surface 68 rides over the slanted top wall 72 of lug 42 as the cap continues to be rotated downwardly. Since cap 14 is maintained in its proper horizontal and vertical orientation with respect to neck 12 by means of the threaded engagement therewith, the camming means 64 pushes downwardly against stops or lugs 42 to level ring 16 into its proper orientation with respect to neck 12. Continued rotation of cap 14 eventually pushes ring 16 downwardly so that teeth 40 of ring 16 engage teeth segments 24 of neck 12. As illustrated in FIG. 13, contact face 66 of camming means 64 ultimately abut against contact face 70 of stop or lug 42 at which time tooth 36 becomes properly registered in a corresponding notch 56 (FIG. 14). Continued tightening or closing rotation of cap 14 causes cap 14 and locking ring 16 to move jointly as a unit because of the interengagement of the positioning means. Rotation of locking ring 16 in the closing direction is permitted by the unidirectional mounting of ring 16 on neck 12. Rotation continues until cap 14 is securely mounted in place. As previously described if an attempt is made to remove the cap without depressing tab 34, this movement is prevented by the engagement of locking tooth 36 in a corresponding notch 56 and rotation of the locking ring is in turn prevented by the firm mounting illustrated in and described with respect to FIG. 15. When, however, tab 34 is depressed locking tooth 36 is withdrawn from its notch 56 and cap 14 may be rotated in a counterclockwise direction with camming face 68 riding over inclined top wall 72 until the cap is removed. During the reverse or opening rotation of cap 14, ring 16 of course remains stationarily mounted on neck 12. After a sufficient amount of contents has been dispensed from container 10, cap 14 is replaced in a conventional manner by screwing the cap on neck 12 whereupon abutting faces 66 and 70 will utlimately contact and tooth 36 will again be properly registered as previously described.

Although FIGS. 11–14 illustrate a manner of assembly wherein the ring 16 is placed on neck 12 in a separate operation prior to the placement of cap 14, it is of course possible to assemble the closure system in other manner. Thus, for example, ring 16 and cap 14 may be preassembled and mounted on the neck as a unit by utilization, for example, of gripping fingers which hold the ring and cap together.

As previously described, the instant invention effectively assures that there will be a proper positioning of the locking tooth with respect to a corresponding locking notch so as to permit the use in the locking system of cheaper material such as polypropylenes which are not noted for memory characteristics. Although the invention has been described with particular respect to the type of closure system of U.S. Pat. No. 3,744,655, the concepts of the invention may be employed in other types of closure systems wherein a cap is removably mounted on a container neck and wherein the cap incorporates locking elements which interengage corresponding locking elements on a locking ring mounted on the neck so that the cap may not be removed unless there is an inactivation of the cap and ring locking means. Accordingly, the above invention is not intended to be limited to the above description but may be practiced as defined in the appended claims.

I claim:

1. A method of assembling a safety closure system on a container having an open neck through which the contents are dispensed comprising mounting a locking ring around the container neck for rotation in only the locking direction, providing a locking tooth on a hinged portion of the locking ring, providing a cap for closing the neck with the cap having complementary locking elements for engagement by the hinged tooth on the locking ring, providing complementary contact elements on the cap and locking ring, mounting the cap on the container neck by rotation in the locking direction until the complementary contact elements contact each other, continuing the locking rotation of the cap while simultaneously rotating the ring in the locking direction with the locking tooth properly registered with respect to the complementary locking elements until the cap has closed the neck dispensing opening.

2. In the method of claim 1 including forming the contact elements on the cap as cam means and on the locking ring as lugs.

3. A method of assembling a safety closure system on a container having an open neck through which the contents are dispensed, comprising loosely mounting a locking ring around the container neck, placing a cap on and in contact with the neck, rotating the cap in the closing direction until the cap contacts the ring, continuing to rotate the cap and ring together in a closing direction by continuing the rotation of the cap until mounting elements on the ring contact complementary mounting elements on the container neck, and moving the ring downwardly on the container neck while rotating the ring with is mounting elements riding over the complementary container mounting elements by continuing joint rotation of the cap and ring.

4. In the method of claim 3 including leveling the ring to an orientation in a plane perpendicular to the longitudinal axis of the container by having the cap contact the ring during rotation thereof.

5. In the method of claim 4 including providing a locking tooth on a hinged portion of the ring for selective engagement with notches in the cap, providing complementary contact elements on the cap and ring, contacting the complementary contact elements during rotation of the cap when the locking tooth is properly registered in a notch, and thereafter jointly rotating the ring and cap.

6. In the method of claim 2 including providing a locking tooth on a hinged portion of the ring for selective engagement with notches in the cap, providing complementary contact elements on the cap and ring, contacting the complementary contact elements during rotation of the cap when the locking tooth is properly registered in a notch, and thereafter jointly rotating the ring and cap.

7. In the method of claim 3 including molding the container with a longitudinal parting line formed thereby, forming the mounting elements on the container neck as two sets of ratchet teeth, each of the sets of ratchet teeth being confined wholly within an opposite quadrant as defined by the parting line and an imaginary perpendicular line bisecting the parting line, and each set being disposed over an arc defined by approximately the same angle as the angle between the sides defining each tooth.

8. In the method of claim 7 including disposing the first tooth wall of one of the sets of teeth away from the imaginary line by a distance equal to one-half the length of a tooth with the first tooth wall of the opposite set being disposed along the imaginary line and the last tooth wall of each set being perpendicular to the parting line.

* * * * *